US005718729A

United States Patent [19]

Harris

[11] Patent Number: 5,718,729

[45] **Date of Patent: *Feb. 17, 1998**

[54] COMPOSITION AND METHOD OF USE FOR AN INTERNALLY-CARBONATING NON-SURFACTANT CLEANING COMPOSITION

[75] Inventor: Robert D. Harris, Logan, Utah

[73] Assignee: Harris Research, Inc., Logan, Utah

[ * ] Notice: The term of this patent shall not extend beyond the expiration date of Pat. No. 5,624,465.

[21] Appl. No.: 335,114

[22] Filed: Nov. 7, 1994

[51] Int. Cl.[6] ..... C11D 7/12; C11D 7/26; C11D 7/32

[52] U.S. Cl. ..... 8/137; 510/434; 510/435; 510/478; 510/488; 510/501; 510/509; 510/278; 8/147; 8/149.1

[58] Field of Search ..... 8/137, 147, 149.1, 8/DIG. 15; 252/8.6, 8.8, 90, 157, 173, 174.14, 174.19; 134/42; 510/434, 435, 478, 488, 501, 509, 278

[56] References Cited

U.S. PATENT DOCUMENTS

| | | | |
|---|---|---|---|
| 4,219,333 | 8/1980 | Harris | 8/137 |
| 4,294,711 | 10/1981 | Hardy et al. | 252/8.75 |
| 4,304,610 | 12/1981 | Weisensel | 134/21 |
| 4,814,095 | 3/1989 | Puchta et al. | 252/8.6 |
| 5,244,468 | 9/1993 | Harris et al. | 8/137 |

*Primary Examiner*—Michael P. Tierney
*Attorney, Agent, or Firm*—Thorpe, North & Western, L.L.P.

[57] ABSTRACT

Carpeting, upholstery, drapery and other textile fibers are cleaned by applying to the fibers, at ambient pressures, an aqueous, chemically carbonated cleaning composition prepared by admixing a carbonate salt solution, and an acid solution, such that the acid reacts with the carbonate salt to produce carbon dioxide coincident with application to a textile to be cleaned. Citric acid and sodium carbonate are the preferred acid and carbonate salt. In a preferred embodiment, urea is added to the acid solution to prevent yellowing and to improve cleaning ability. The compositions are preferably prepared and applied at an elevated temperature in the range of between about 140° and 200° F.

22 Claims, No Drawings

COMPOSITION AND METHOD OF USE FOR AN INTERNALLY-CARBONATING NON-SURFACTANT CLEANING COMPOSITION

FIELD OF THE INVENTION

This invention relates to internally-carbonating non-surfactant compositions for cleaning textile fibers. More particularly this invention relates to non-surfactant compositions which are internally carbonated by mixing the components of the composition coincident with their application to a textile to be cleaned so as to develop a carbonating or carbon dioxide producing reaction on the textile resulting in the removal of soils and other materials from the textile. This carbonating composition has an improved ability to penetrate textile fibers and dissolve and/or lift both inorganic and organic materials from the fibers, and the ability to use carbon dioxide effervescence even when the components are applied at relatively high temperatures.

BACKGROUND OF THE INVENTION

There are myriad types of cleaning compositions for cleaning textile fibers such as carpets, upholstery, drapery, clothing, bedding, linens, and the like. Most of these are based on soaps or other detergents which are generically referred to as "surfactants." By "surfactant" is meant a synthetic amphipathic molecule having a large non-polar hydrocarbon end that is oil-soluble and a polar end that is water soluble. Soap is also an amphipathic molecule made up of an alkali salt, or mixture of salts, of long-chain fatty acids wherein the acid end is polar or hydrophilic and the fatty acid chain is non-polar or hydrophobic. Surfactants are further classified as non-ionic, anionic or cationic. Anionic or nonionic detergents are the most common.

Surfactants and soaps are formulated to loosen and disperse soil from textile fibers either physically or by chemical reaction. The soil can then be solubilized or suspended in such a manner that it can be removed from the fibers being cleaned. These function because the hydrophobic ends of the molecules coat or adhere to the surface of soils and oils and the water soluble hydrophilic (polar) ends are soluble in water and help to solubilize or disperse the soils and oils in an aqueous environment. A major problem associated with the use of surfactants in cleaning fibers is that large amounts of water are generally required to remove the surfactants and suspended or dissolved particles. Also, surfactants generally leave an oily hydrophobic coating of the fiber surface. The inherent oily nature of the hydrophobic end of the surfactants causes premature resoiling of the fiber surface even when the surfaces have a surfactant coating which is only a molecule thick. The greater the concentration of surfactants used, the greater the potential for resoiling after cleaning. The residues left by surfactants also sometimes cause irritation or allergic reactions to people who are sensitive to these chemicals.

There are also environmental problems associated with the use of soaps and other surfactants. In addition to requiring relatively large amounts of water, some are non-biodegradable and some contain excessive amounts of phosphates which are also environmentally undesirable. Up to now, however, the inherent benefits of surfactants have outweighed the disadvantages of resoiling, skin, membrane or eye irritation, allergic reactions and environmental pollution.

This concern over health and the environment has prompted an emphasis on the use of less toxic, more natural cleaning components. The quest for carpet cleaning compositions that have a balance of cleanability and resoiling resistance, however, has sometimes resulted in compositions containing unnatural components that have a greater potential to cause allergenic reaction and other health and environmental problems. Normal soaps prepared from the base hydrolysis of naturally occurring fats and oils are not suitable for carpet cleaning because of the propensity of their residues to attract soils. In order to make these residues less soil attracting, detergents are synthetically modified.

Another long existing problem in carpet cleaning is oxidative yellowing or "brown out" as it is commonly called. The usual conditions that increase the potential for brown out are a higher pH cleaner and/or prolonged drying times. Ordinarily the higher the concentration of solids in the cleaning composition the greater the potential for this oxidative yellowing to produce a noticeable discoloration on the carpet. Thus, by having a high pH and requiring large quantities of water to flush out residue, soaps and other surfactants tend to increase the risk of brown out.

Urea has been added to synthetic detergent compositions which contain, as the active ingredients, monoalkyl ethers of polyoxyalkylene glycols, monoalkyl ether of polyethylene glycol, glycerine and/or propylene glycol, and disodium edetate (Soviet Union Patent 1618758, Jan. 7, 1991). Urea is an optional additive to a low temperature detergent containing nonionic or anionic surfactants and a host of other ingredients such as solvents, enzymes and the like. See for example the following German Democratic Republic Patents (GDR) Patents 286178, 286179, 286180, and 286181, all dated Jan. 17, 1991. German Republic Patent 4001688, Aug. 16, 1990, discloses a creamy powder containing an adsorptive organic or inorganic powder mixture, water and antistatics with 1–10% weight of urea or urea derivatives, and/or cyclic carboxamides dissolved in water. None of the above references disclose non-detergent cleaning compositions containing the combination of carbon dioxide and urea as being the active cleaning ingredients in an aqueous solution.

The combination of a silicate fabric softening agent, a neutralizing or "souring" agent such as citric acid, a disintegrating agent comprising citric acid, hydrogen, carbonate and a filler material which may be ammonium sulfate, zeolite A or urea has been described in connection with the laundering of fabrics. In U.S. Pat. No. 4,814,095, "After Wash Treatment Preparation Based On Layer Silicate" the use of these compounds is demonstrated for use as a fabric softener. However, as noted on col. 3, lines 21–25 of that patent, the crucial performance feature of the composition, i.e. the fabric-softening property, is distinguished by the presence of a suitable layer silicate. As the patent discusses, the silicate layer is deposited on the textile fibers. While this may be advantageous for softening fabrics, it is undesirable for cleaning carpets, upholstery and other fabrics which are not thoroughly rinsed due to the fact that the excessive silicate residue can be abrasive. In addition, the residue leaves the carpet, upholstery or other material more prone to resoiling than carpet or upholstery without the residue. Furthermore, the large amounts of water required to flush silicate particulates from the carpet or upholstery increases the textile's drying time and increases the risk of brown out.

A significant improvement in the art of cleaning textile fibers, and carpets and upholstery in particular, is taught in U.S. Pat. No. 4,219,333. This patent shows that, when detergent solutions are carbonated and applied to the fibers, the solution rapidly penetrates the fibers and, through the effervescent action of the carbonation, quickly lifts the suspended soil and oil particles to the surface of the fiber from which they can be removed by vacuuming or transfer to an adsorptive surface such as to a rotating pad. Moreover, because less soap or other surfactant needs to be applied to the fibers, less water is needed to affect the cleaning, the fibers dry more rapidly than do fibers treated with conventional steam cleaning or washing applications, and little residue is left on the fibers. This results in less resoiling due to the reduced residue and in a decreased likelihood of brown out because of the more rapid drying of the fibers. Although this process is clearly advantageous over prior art methods, it still requires the use of some surfactant and, in some instances, added phosphates, which are undesirable in today's environmentally conscious society.

The invention as claimed in U.S. Pat. No. 5,244,468 provides some resolution to the surfactant problem in that it claims the use of carbonated urea containing non-detergent compositions formed from the reaction between a carbonate salt and a naturally occurring acid or acid forming material but still requires the presence of a positive gauge pressure to retain the proper degree of carbonation.

In the past, in order to prepare a carbonated solution it was necessary to pressurize the cleaning solution in a container with carbon dioxide from an outside source, e.g. a $CO_2$ cylinder, and shake the container, preferably during $CO_2$ introduction, to insure that the solution was carbonated. Carbon dioxide tanks necessary to accomplish this pressurization are heavy and inconvenient to have on site for attachment to sprayers when cleaning solution is being applied to carpets. The benefits of carbon dioxide as a volatile builder salt have outweighed the inconvenience of having a carbon dioxide tank on location during cleaning. In addition, a disadvantage of externally carbonating a solution is that excess carbon dioxide may be expelled into the air or surrounding atmosphere, and there is always the danger that carbon dioxide can be expelled accidentally from the pressurized cylinder in which it is contained.

It has also been known for a significant amount of time that hot cleaning solutions will clean textiles and other materials better than cool solutions. Many currently available carpets require an elevated temperature for proper cleaning. However, until the present invention, it has been unclear how to achieve the cleaning advantages of a carbonated solution combined with those of a heated solution. When a carbonated solution is heated, the cleaning efficiency gained by heating the solution is offset by the diminished solubility of the carbon dioxide in the solution. Thus, the more the solution is heated, the less carbonation it will carry for cleaning.

Additionally, it has also been known that the pH of a cleaning solution may significantly affect its cleaning efficiency. As was discussed above, new generation carpets are sensitive to elevated pH solutions, and will be damaged if an alkaline solution stays on the carpet for any significant length of time. Until the present invention, it has been difficult to obtain the benefits of elevated pH solutions without affecting the stain resistance of new generation carpets, or causing brown out.

Thus, there is a need for a cleaning solution which combines the benefits of a carbonated solution and those of a heated solution, without the many problems associated with surfactants, silicates and other fillers.

OBJECTS AND SUMMARY OF THE INVENTION

It is therefore an object of the present invention to provide a cleaning composition that contains completely or at least substantially materials found in nature.

It is a further object of the present invention to provide a cleaning composition, not based on surfactants, which rapidly penetrates textile fibers removing the soils and oils therefrom with a lifting action.

It is also an object of this invention to provide a carbonating cleaning composition at an elevated temperature wherein the carbonating reaction rapidly penetrates textile fibers, suspending soils and oils for removal without leaving a soil attracting residue on the fibers.

An additional object of this invention is to provide a process for the cleaning of textile fibers with a heated carbonating solution wherein soils and oils are effectively removed from the fibers, without the use of surfactants, and suspended in an aqueous environment for a sufficient time to allow the suspended materials and aqueous environment to be extracted or removed from the fibers.

It is a further object of this invention to provide a heated carbonating cleaning solution containing urea wherein the carbonating reaction and application of the carbonating solution occurs and is utilized at an ambient pressure.

It is another object of this invention to provide a non-surfactant cleaning composition which comprises two solutions, preferably at elevated temperatures, which may be mixed coincident with their application to a textile to be cleaned to create an internally-carbonating solution with the carbonating reaction occurring immediately prior to application or directly on the textile being cleaned.

A further object of this invention is to provide a cleaning composition at elevated temperatures which is internally-carbonated by chemical reaction and does not require the presence of pressure from an externally applied gas to create or maintain carbonation.

These and other objects are accomplished by means of a cleaning solution which is not maintained under a positive gauge pressure by means of an externally applied gas and which is prepared by combining an acid or acid forming material containing aqueous solution which is natural and non-polluting to the environment, and a carbonate salt solution that produces carbon dioxide when reacted with the acid solution. Applying the acid and carbonate salt solutions to a textile simultaneously or in close succession, and preferably at an elevated temperature, results in a carbonating reaction which provides a unique cleaning ability that is unexpected since there are no detergents or other cleaning agents in the solution. To further enhance cleaning and reduce the risk of brown out, urea or an urea analog may be added to the solution.

The present composition removes soils and oils from fibers by suspending the soil in the freshly carbonated solution until it can be removed. This composition is concurrently internally carbonating and applied at ambient pressure, thereby avoiding the extra step of precarbonating the solution by external means such as highly pressurized carbon dioxide tanks or maintaining the pressure by means of externally applied carbon dioxide or other gases. Additionally, the present composition does not leave soil attracting residue on the fibers and therefore does not attract or retain soils or oils which come into contact with the fibers following cleaning. Furthermore, because the carbonating reaction occurs infinitesimally before or at the time of application on the textile, the ingredients may be heated to achieve a heated composition while retaining the effervescent action of freshly prepared carbon dioxide bubbles. The reaction of the ingredients causes the newly prepared carbon dioxide to penetrate the fibers, thereby making the carbon dioxide solubility or temperature of the composition of little importance.

The combination of urea or an urea analog with carbon dioxide produces an interactive substance that either adheres to fabric fibers by hydrogen bonding or which may surround soil and oil particles imbedded in the fibers with negative ions, allowing such particles to disperse and be suspended in the surrounding aqueous environment from which they can be removed by vacuuming or by adsorption onto a soft fabric pad or towel. In either event, the carbonation allows the solution to penetrate the fibers more rapidly and, with its accompanying effervescent action, break up and lift the suspended particles away from the fibers for more efficient removal.

The cleaning mechanism of the instant invention is quite different from the well-understood surfactant cleaning approach. Rather than the formation of micelles, the composition, particularly when urea or an urea analog is present, is believed to hydrogen bond to the textile fiber as stated above. Once loosened, the soil and oils can be transferred to an absorbent pad or other removal means.

In addition to the cleaning action described above, the composition also serves to prevent resoiling. Unlike surfactants, which increase the risk of resoiling with increased concentrations, the cleaning composition of the instant invention actually reduces resoiling due to the strength of the bond between the components in the composition and the textile fiber. This supports the position that the composition is bonding to the fiber surface and that soils demonstrate less adhesion to this combination than to the fibers itself.

The composition can also be used with other protectors such as fluorochemical and other polymers such as are marketed under tradenames such as "Teflon" or "Scotchgard". When other cleaning agents are used with protectors, they tend to diminish the effectiveness of the protector. When the cleaning composition of the instant invention is used, however, the soil protection is actually enhanced rather than diminished.

The compositions of the present invention can be applied to fibers as internally carbonated solution, the degree of carbonation which will depend upon whether the solutions are mixed immediately before being applied (i.e. mixed as they are sprayed on the textile) or whether one of the solutions is applied to the textile, and then followed by the other solution.

DETAILED DESCRIPTION OF THE INVENTION

As used herein the term "acid" or "acid forming material" shall mean a member selected from the group consisting of citric acid, succinic acid, tartaric acid, adipic acid, oxalic acid, glutaric acid, malic acid, maleic acid and mixtures thereof. Citric acid or a citrate salt are preferred.

The term "carbonate salt" shall mean a member selected from the group consisting of sodium carbonate, sodium percarbonate, sodium bicarbonate, lithium carbonate, lithium percarbonate, sodium bicarbonate, potassium carbonate, potassium percarbonate, potassium bicarbonate, ammonium carbonate and ammonium bicarbonate and mixtures thereof. Sodium carbonate, sodium bicarbonate or mixtures of sodium carbonate and sodium bicarbonate are preferred.

The term urea or urea analog shall mean urea or a nitrogen containing compound which may interact and or dissociate to form urea. For example ammonia and carbon dioxide can interact to form urea, cyanamide and water interact to form urea, heating of urea forms biuret. Therefore, in a heated carbonating atmosphere the term urea analog may be represented by a member selected from the group consisting of ammonia, cyanamide, dicyanoamide, and biuret. However, urea is preferred.

Prior to the issuance of U.S. Pat. No. 5,244,468, the ability of a solution of an acid or acid forming materials , and a carbonate salt that produces carbon dioxide when reacted with the acid to surround and suspend soil and or hydrophobic particles such as greases, oils and the like is not believed to have been previously known or used in the cleaning arts. Such combinations, along with other ingredients, have been used in association with surfactants to control or maintain the pH of the cleaning solution. Moreover, the carbonating of such combinations coincident with their use as cleaning agents per se is novel and unexpected particularly when the carbonating is effected at elevated temperatures at the time of utilization.

The addition of additives such as urea or an urea analog further increases the cleaning ability of the carbonated solution. The reaction resulting from the admixture of carbonate salts and acids produces carbon dioxide which associates with the urea to either hydrogen bond to the fibers or produce an interactive substance or complex that lifts the soil from the fabric. While it is not known for a certainty, as an adjunct to the discussion relative to hydrogen bonding to the fibers as given above, it is also possible that the urea in the composition functions to form an overcoat over the soil and/or oil particles. The urea coating acts like a primer to which the carbon dioxide and ionic materials present in the solution either physically or chemically adhere, e.g. by hydrogen bonding, etc. In a way, the urea may function as the hydrophobic end of a detergent and the carbon dioxide and ionic materials function as the hydrophilic (polar) end of the detergent such that the soil or oil particle is surrounded and then suspended into the solution. It is not known whether the interaction between the urea and carbon dioxide actually produces a complex or just sufficient physical interaction to accomplish the cleaning purpose. Regardless of the theory or mode of operation, it is known that the carbon dioxide suspends the soil particles in the solution so they can be vacuumed or collected on an absorbent material.

Other additives commonly found in commercial cleaning compositions may be added without departing from the scope of this invention provided they do not interfere with the carbonating reaction and, when used with urea, the interaction of the urea with the carbon dioxide. These may include compatible bleaches, optical brighteners, fillers, fragrances, antiseptics, germicides, dyes, stain blockers and similar materials.

The coincident carbonating and application of the composition results in a rapid lifting action due to the presence of a multitude of effervescent carbon dioxide bubbles. The soils or oil on the fibers being cleaned are either surrounded by the complex of carbon dioxide and urea (if added), or prevented from adhering to the fibers by the hydrogen bonding of the carbon dioxide and urea to the fibers. In either event, the soils are freed and can be lifted from the fibers into the surrounding carbonated aqueous environment. By "aqueous" is meant the presence of water, but that does not suggest that copious amounts of water need to be present. A slight dampening of the fiber may be sufficient to promote the lifting action of the effervescent carbonating solution and to loosen or dislodge the soil or oil particle from the fiber. The urea and carbon dioxide interactive substance or complex holds the soil particles in suspension for a time sufficient for them to be removed from the fiber by means of vacuuming or adsorption onto a textile pad, toweling or similar adsorbent material. An important advantage of this invention is that only minimal amounts of solution are required to effect a thorough cleaning of textile fibers without leaving any soil attracting residue. Normally, excess amounts of water are used to remove unwanted detergent residues.

The terms "coincident", "concurrent", "simultaneous", "infinitesimally before", "immediately after" and the like, when referring to the carbonating reaction and application of the carbonated solution to a fiber substrate, means that the acid and carbonate salt components, along with urea, are brought together in an aqueous admixture just prior to application to the fiber substrate, at the time of application on the fiber substrate or by sequential application of the acid and carbonate components on the fiber substrate. Obviously, when mixed just prior to application, the carbonating reaction begins infinitesimally before the carbonated solution contacts the substrate. On the other hand, if a solution of acid or carbonate salt is placed on the fiber substrate prior to the other solution being applied, i.e. sequentially, the carbonating occurs "on" the substrate fibers "upon" or "immediately following" the application of the second solution. Another option is to apply an acid containing solution and a carbonate containing solution simultaneously or in such a manner that the carbonation reaction occurs at the time the solutions reach the fiber substrate. In any event, the time lapse between bringing the acid solution and carbonate solution together and the concurrent release of carbon dioxide is minimal and all embodiments are encompassed by the above terminology. What is important is that the release of carbon dioxide, with or without the presence of urea or a urea analog, at an appropriate pH occurs in such a manner as to promote carbon dioxide expansion, contact between the fibers to be cleaned with carbon dioxide and urea, if present, from the solution resulting in the maximum cleaning ability of the non-detergent solution.

As noted above the components of the cleaning composition may be applied to the textile simultaneously, e.g. mixed immediately before application, or during application. In the alternative, the components of the cleaning composition may be applied, and thus mixed, in any desired order. For example, a solution containing urea and an acid can be sprayed directly on the textile, followed by the carbonate solution. Alternatively, the carbonate solution could be sprayed first and then the solution containing the acid and the urea. Either procedure works well because solutions with a pH which is not neutral tend to clean much better than those that are neutral. By applying one of the solutions first and then the other, the solution on the carpet is temporarily moved from a neutral pH and cleans the carpet more efficiently. While the solutions could also be mixed before application to the carpet or other textile, the components should not be mixed a significant amount of time before application (i.e. precarbonated), as the carbon dioxide will escape over time unless maintained under a positive gauge pressure. Those skilled in the art will recognize that numerous combinations and spraying sequences could be applied, and that some or all of the ingredients could be heated prior to being applied to the carpet. The acid, carbonate salt and urea components of the invention are all products commonly found in nature and, when properly utilized, are non-polluting to the environment.

Typically, the urea is added to the citric acid due to increased solubility in acidic solutions. However, it could be added independently (i.e. three solutions being mixed) or could even be mixed with the carbonate solution.

In a preferred embodiment, the acid solution and carbonate salt solution will be brought together just prior to or at the time of contact with the textile fibers being cleaned. One means for such application is disclosed in copending application Ser. No. 08/335,210, titled "Dual Solution Application System" and filed of even date herewith as Attorney Docket No. T2433. In the system disclosed, the acid and carbonate salt solutions are heated in separate reservoirs or containers to about 140°–200° F. and pumped from their respective reservoirs to a valve means for each solution. When the valves are simultaneously opened, the hot solutions enter a small mixing chamber through a restricted orifice for each solution. There is a pressure differential across the orifice which causes the hot solutions to enter and combine in the mixing chamber at essentially ambient pressure. The lowering of the pressure across the orifices prompts the hot solutions to enter the chamber with turbulence or mixing to begin the carbonating reaction. The mixture then exits the chamber through a larger exit orifice which does not restrict the pressure but merely directs the flow of the mixed carbonating solution through a line to a manifold directly above the textile fibers for deposit on the fibers in sheet or large droplet form. The time lapse between the valves being opened, the two solutions entering the mixing chamber, passing to the manifold and onto the textile fibers is momentary, i.e. from fractions of a second up to a few seconds. The carbonating reaction begins immediately and lasts for up to 10 to 15 seconds. The temperature drop between the hot solutions at the valves and the carbonating solution exiting the manifold is only a few degrees, i.e. about 2 to 15 degrees depending on the length of the lines feeding the hot solutions from the reservoirs to the valves and the distance from the mixing chamber to the manifold.

Another method of practicing the invention is to apply a buffered solution containing the carbonate to the textile first. The buffered carbonate solution may provide for a greater degree of cleaning due to the relatively high pH of the solution in that stains, greases, and other materials may be more readily removed at an elevated or more alkaline pH. However, high pH solutions may damage some new generation carpets if prolonged contact is permitted. Thus by adding a sufficient amount of citric or some other weak acid to the carbonate solution as a buffer, the pH can kept between about 8 and 11. This range prevents the carpet from being damaged in the event that the acid solution is not applied immediately after the carbonate solution, as may be the case if the operator runs out of acid solution. While buffering the carbonate solution may somewhat lessen the total amount of carbon dioxide that is generated by reacting the acid and carbonate solutions, keeping the carbonate solution at a pH level between 8 and 11 enables the mixture to produce enough carbon dioxide to thoroughly clean the carpet or other textile.

Likewise, the acid solution, usually citric acid, may be buffered by a small amount of carbonate salt to a pH of between about 3 to 6. This pre-buffering of the two solutions provides a means that, should either solution be applied to a fiber substrate without the other, the substrate will not be harmed. Moreover, when the two solutions do combine they will have a relatively neutral pH. By the terms "relatively" or "generally" neutral pH is meant a pH that will not harm the fabric due to either an acidic or basic nature if left on the fabric for an extended period of time. Such a pH will usually be in the range of 6 to 8 and will preferably be about 7. Thus, the textile being cleaned undergoes a momentary increase in pH, to improve cleaning, followed by significantly more effervescent activity than has been achieved with prior methods utilizing physically generated carbon dioxide (e.g. from a pressurized container). Each of these results in a cleaner textile, without the use of surfactants and without damaging the carpet. The application of the acid helps reduce the risk of brown out or other damage to the carpet.

It may also be desirable to buffer the acid and carbonate salt solutions in their respective reservoirs even if they are to be applied simultaneously just as a precaution against any adverse consequences resulting from either too high or low pH.

The carbonating solution, whether applied as a carbonate solution and an acid solution or brought together as a single solution for contact with the fiber substrate, will preferably be applied as a "sheet". By "sheet" is meant a thin sheet, film, large droplet or tear of solution as contrasted to an atomized spray or mist of small droplets. It is difficult to contact a fiber substrate with an atomized mist or spray of small droplets at an elevated temperature because the large surface area to mass of the atomized particles. Such large surface areas causes the solution to cool rapidly between the time the droplet leaves a spray head or atomizer and contacts a fiber substrate. However, when utilized as a sheet, the temperature of the solution may be more precisely controlled. Because of the rapid generation of carbon dioxide resulting from the combining of heated solutions, the carbon dioxide expands rapidly to produce greater volume and surface and thus cover a fiber substrate as effectively as an atomized solution. Furthermore, application of a sheet, as contrasted to an atomized mist, is safer from a health standpoint since the chances of inhaling the composition are greatly reduced.

In accordance with the preferred method, both of the carbonate and acid solutions may be applied to the carpet or other textile in sheets of solution at a temperature ranging from ambient up to about 200° F. Many "Extra Life" carpets require that the carpet fiber be momentarily increased to a temperature in excess of about 140° F. in order to restore its "memory" i.e. reset the yarn fibers to their original orientation. Therefore, it may be desirable to apply solutions at temperature ranges of between about 140° to 200° F. Because the carbonating reaction occurs just before or on the carpet or other textile, the lack of carbon dioxide solubility in a heated solution is of minimal importance, as the carbon dioxide bubbles still form and fully penetrate the carpet. As noted above, the carbonating action lasts for up to about 15 seconds even in hot solutions. Furthermore, the previously unavailable cleaning advantages of a heated composition are gained.

Normally, the acid-base reactions have very fast reaction rates which are controlled by diffusion. However, the reaction rate may be slowed by a number of equilibria involved. For example, in the reaction of citric acid with sodium carbonate, the release of carbon dioxide is controlled by the following equilibria:

$$H_3C_6H_5O_7 \rightleftharpoons H^+ + H_2C_6H_5O_7^-$$

$$H_3C_6H_5O_7^- \rightleftharpoons H^+ + HC_6H_5O_7^{2-}$$

$$HC_6H_5O_7^{2-} \rightleftharpoons H^+ + C_6H_5O_7^{3-}$$

Once these protons are released from the weak acid, they must then react with the carbonate ion before carbon dioxide can be released. These equilibria are as follows:

$$H^+ + CO_3^{2-} \rightleftharpoons HCO_3^-$$

$$H^+ + HCO_3^- \rightleftharpoons H_2CO_3$$

$$H_2CO_3 \rightleftharpoons H_2O + CO_2$$

These complex equilibria slow the production of $CO_2$ enough to allow considerable chemical release of $CO_2$ to occur after the cleaning solution has been applied to the carpet or other fiber substrate to be cleaned. Thus, chemically produced and released carbon dioxide is more effective than physically released carbon dioxide (i.e. from a pressurized container) in that the cleaning solution can be hot, and more carbon dioxide can be released once the solution has been absorbed into the soil that is to be removed from the carpet. Similar results may be obtained using any of the polybasic acids and carbonate salts listed above.

In some instances it is not visually apparent that the carbonating reaction is occurring when the heated solutions are combined. However, when a textile fiber is immersed in a hot admixed acid/carbonate salt solution there is an immediate presence of effervescence on the surface of the fibers, indicating that the carbonating reaction is present.

A distinct advantage of the present invention is that the solution is self-neutralizing. In the embodiment wherein the carbonate solution is applied first followed by the acid containing solution, the temporary higher pH attributable to the carbonate salt solution allows the solution to clean more efficiently due to the pH elevation. Because the pH drops to a safe, neutral pH within a short period of time, the safety for pH sensitive stain resistant carpets is maintained. The chemical reaction which produced the carbon dioxide also lowers the pH. Therefore, the carbonate solution is effectively neutralized by the weak acid solution. Also, these two reactants produce a third material, sodium citrate, which acts as a buffer to maintain the pH at a near neutral level. The overall reaction may be depicted as follows:

$$2H_3C_6H_5O_7+3Na_2CO_3 \leftrightharpoons 3H_2O+3CO_2+2Na_3C_6H_5O_7$$

It is critical that the amounts of acid and carbonate salt along with urea which mix together are carefully controlled and are consistent to produce a neutral solution containing the proper amount of urea. Therefore, concentrations of solutions and flow rates must be monitored and controlled and adjusted as necessary to provide a neutral environment having the proper degree of carbonation and neutralization.

The ratio of acid to carbonate salt to urea may vary somewhat depending on the specific carbonate salt and acid utilized. Typically, the acid and carbonate salts will each be present in their respective solutions in amounts ranging between about 0.1 and 16% by weight in each. Preferably these will be present in amounts ranging between about 0.5 and 10.0% by weight in each solution. Therefore, assuming that each solution is combined on an equal volume basis, the combined solution would contain each ingredient in amounts ranging from between about 0.05 and 8.0% each with amounts of between about 0.25 and 5% being preferred. However, these are guidelines only and the only limitation relative to concentration is what is functional as any amount may be used which will not require copious amounts of water to be removed from the carpet or other textile. The actual amounts of each ingredient in said combined solution is not readily determined due to the reaction between the acid and carbonate salt and the accompanying release of carbon dioxide.

Ratios of dibasic acids to carbonate salt will be different from ratios of tribasic acids to carbonate salts as will the ratios of acids to carbonates, bicarbonates and percarbonates, etc. What is important is that the ratio of acid to carbonate salt be such that the overall reaction results in solution having an essentially neutral pH following the release of carbon dioxide from the reaction mixture. When used as an additive, the quantity of urea or urea analog added typically will be between 0.1 and 5 percent by weight of the combined acid and carbonate solutions at the time of combination, e.g. not taking into consideration the loss of weight caused by the carbon dioxide release and attendant evaporation of solution.

In accordance with the principles of the invention, ingredients such as bleaches, optical brighteners, stain blockers and the like, may be added to the solutions provided that these ingredients do not significantly interfere with the ability of the mixture to clean the textile and impart anti-resoiling properties to the textile fibers. Therefore, ingredients such as silicates for fabric softening and filling agents such as zeolites and other components which leave a residue on a textile fiber unless removed by copious amounts of water are not permissible additives.

The solution can also applied to the textiles, particularly carpeting or upholstery, in any other suitable manner, i.e. by pouring the composition onto the textiles or submerging the textile in the composition. When so applied the carbonated cleaning composition breaks into a myriad of tiny effervescent bubbles which rapidly penetrate into the textile fibers.

Preferably, following application of the carbonating solution, it may be mechanically worked into the fibers by a carpet rake, agitation or similar means. The effervescent action lifts the soil or oil particles to the surface of the fibers where they can be readily removed by vacuuming or adsorption onto a different, but more adsorbent textile, such as a rotating pad or piece of toweling. Because the carbon dioxide bubbles promote rapid drying, little or no solution is left on the fibers being cleaned. This contributes to the anti-resoiling properties of the invention. In addition to being a key ingredient to enhance cleaning, it is believed that urea also plays an important role in preventing yellowing, and resisting resoiling.

As stated above, the acid solution, carbonate solution and urea can be mixed and applied to make a composition in any desired order. It is the resulting internally-carbonating composition to which the present invention is drawn.

In addition to the above, it has been found that using "hard" water to form the carbonate solution causes calcium carbonate to precipitate from the solution. Over time, the precipitate interferes with the valves and filters of cleaning machines. It has been found that adding a small but effective amount of a chelating agent, such as EDTA (ethylene diamine tetraacetic acid) prevents the calcium carbonate precipitate from interfering with the practice of the other aspects of the invention.

EXAMPLES

A light, cream colored, level loop, nylon carpet was selected for purposes of testing. One section of the carpet was removed as the control. The remainder of the carpet was soiled extensively with crankcase oil and dirt, and the soiled carpet was trampled repeatedly with foot traffic over a 24 hour period. The carpet was irreparably soiled but was considered a useful material for purposes of showing cleaning effectiveness of various test solutions within the scope of the invention. This carpet was divided into four 2×2 foot sections. The reflectometer used was a Photovolt 577 Reflectance and Gloss Meter with a "D" search unit. The reflectometer was set at 99.9% by using the control sample. All four sections had an average reflectance within 1%. All sections were cleaned using solutions prepared with the same set of ingredients.

Example 1

A solution containing 2.6% citric acid and 1.30% urea was heated to 180° F. Another solution containing 2.6 sodium carbonate was also heated to 180° F. A 90 ml sample of each heated solution was mixed and metered immediately onto the carpet as a sheet of liquid at ambient pressure as described above. There was noticeable effervescence as the solution reached the carpet fibers.

Example 2

The second section was treated with identical equipment and solutions as described in the first section except that the solutions were mixed and applied at room temperature. There was still noticeable effervescence resulting from the carbonating reaction on the surface of the carpet fibers but not as pronounced as in Example 1.

Example 3

The third section was cleaned using 90 ml of the same two solutions, but the solutions were mixed in a single container 30 minutes before application. The resulting solution was heated to 180° F. before application. There was no noticeable bubbling indicating that carbonation was present in the solution.

Example 4

The fourth section was cleaned using the same solution and conditions as described in section three except that the solution was applied at room temperature.

Results:

Each carpet sample was then rubbed fifty times with a terry cloth within five minutes of application and let stand for about 30 minutes until dry to the touch. Three reflectometer reading were then taken of each sample. The results reported were the average of three readings which did not vary more than ±2%. The average reflectance for each section after cleaning was the following:

Example 1 63.3%

Example 2 47.8%

Example 3 49.2%

Example 4 45.9%

In considering the above results it is to be remembered that the treated sections were soiled beyond recovery. However, the results indicated that the hot carbonated solutions of Example 1, applied at ambient pressure, clearly removed the most soil. The solutions of Example 3, precarbonated but not immediately used, were still somewhat more effective when applied at ambient pressure as a hot solution. There was probably some residual carbonation remaining in the Example 3 solutions when used. The solutions carbonated and applied at ambient pressure and temperature as shown in Example 2 were almost equivalent to those of Example 3 showing that carbonation at the time of application (Example 2) and application of a heated precarbonated solution (Example 3) each contributed to the cleaning properties as they were somewhat better than the precarbonated solutions allowed to set for a time and then applied at ambient temperature and pressure as shown in Example 4.

Had the solutions of Examples 1–4 been applied to a less soiled carpet, as would be found in actual use, the reflectometer readings would have been considerably higher. However, the ranking of the order of cleaning effectiveness would have been the same.

Example 5

To avoid solutions with high and low pH, buffered solutions were prepared and tested as described in Example 1. The first solution in this test contained 1% citric acid, 0.65% urea, and 0.3% sodium carbonate as a buffer. The second solution contained 1% sodium carbonate and 0.3% citric acid as a buffer. The pH of the first solution was about 5. The pH of the second solution was about 9.5. The same procedure used in Example 1 was followed except that a normally soiled light colored carpet removed from a hallway was used to evaluate these solutions when admixed and applied as a carbonating solution. The reflectance after cleaning was found to be 90.8%.

Example 6

An acid solution and a carbonate salt solution at a temperature of about 140°–200° F. were mixed in equal volume in such a way as to produce an internally carbonating reaction when applied as a sheet at the surface of the fiber in the manner as described for Examples 1–4.

ACIDS

Solution A contained 2.6% citric acid

Solution B contained 2.6% citric acid and 1.3% urea.

Solution C contained 2.6% citric acid and 1.3% urea and 0.2% EDTA.

Solution D contained 2.7% malic acid.

Solution E contained 2.7% malic acid, and 1.3% urea.

Solution F contained 3.0% tartaric acid.

Solution G contained 3.0% tartaric acid and 1.3% urea.

Solution H contained 3.0% tartaric acid and 1.3% urea and 0.2% EDTA.

Solution I contained 2.4% succinic acid.

Solution J contained 2.4% succinic acid and 1.3% urea. and

Solution K contained 2.4% succinic Acid and 0.2% EDTA.

BASES

Solution L contained 2.6% sodium carbonate.

Solution M contained 2.6% sodium carbonate and 0.2% EDTA.

Solution N contained 2.6% sodium carbonate and 1% sodium borate.

Solution O contained 3.4% potassium carbonate and 0.2% EDTA. and

Solution P contained 3.4% sodium bicarbonate.

The first column represents the acid solution used in a particular mixture; the second the carbonate; and the third indicates the relative reflectometer results achieved.

| Acid | Base | Result |
|---|---|---|
| B | M | 63.3% |
| B | L | 62.8% |
| B | N | 60.2% |
| B | O | 63.1% |
| B | P | 58.2% |
| A | L | 55.4% |

-continued

| Acid | Base | Result |
|---|---|---|
| C | M | 63.2% |
| D | M | 55.4% |
| E | M | 62.7% |
| F | M | 56.9% |
| G | M | 61.7% |
| H | M | 62.0% |
| I | M | 54.1% |
| J | M | 60.3% |
| K | M | 56.8% |
| E | L | 62.9% |
| A | M | 55.8% |
| H | O | 61.4% |
| J | P | 58.3% |

Although this invention has been described and illustrated by reference to certain specific formulation, these are exemplary only and the invention is limited only in scope by the following claims and functional equivalents thereof.

What is claimed:

1. A method of cleaning textile fibers which comprises applying to said fibers, an internally-carbonating cleaning composition at ambient pressure and at an elevated temperature of at least 140° F. said composition being prepared coincident with said application by combining solutions at said elevated temperature consisting essentially of (a) an aqueous carbonate salt solution comprising 0.1 to 16% by weight of a carbonate salt, said carbonate solution having a pH of between about 8 and 11; and (b) an aqueous acidic solution comprising 0.1 to 16% by weight of an acid, said acidic solution comprising an acid having a pH of between about 3 and 6 wherein the relative proportions of carbonate salt, and acid are such that the carbonate reacts with the acid when said solutions are combined so as to create an aqueous composition having a generally neutral pH and from which carbon dioxide is released into the surrounding atmosphere causing carbon dioxide to come into contact with said textile fibers.

2. The method according to claim 1 wherein the carbonate salt is a member selected from the group consisting of sodium carbonate, sodium percarbonate, sodium bicarbonate, lithium carbonate, lithium percarbonate, lithium bicarbonate, potassium carbonate, potassium percarbonate, potassium bicarbonate, ammonium carbonate and ammonium bicarbonate.

3. The method according to claim 2 wherein the acid solution contains an acid selected from the group consisting of citric acid, succinic acid, tartaric acid, adipic acid, glutaric acid, malic acid and oxalic acid.

4. The method according to claim 3 wherein the carbonate salt is sodium carbonate.

5. The method according to claim 4 wherein the acid is citric acid.

6. The method according to claim 3, wherein said composition also contains urea or an urea analog.

7. The method according to claim 6 wherein said composition contains urea.

8. The method according to claim 7, wherein the urea comprises 0.1 to 5 percent of the composition.

9. The method according to claim 3 wherein said acid solution is buffered by a carbonate salt to a pH of between about 3 and 6 and said carbonate salt solution is buffered by an acid at a pH of between about 8 and 11 prior to said coincident preparation and application of said composition to textile fibers.

10. A method of cleaning textile fibers which comprises (a) providing an aqueous carbonate salt solution comprising 0.1 to 16% by weight of a carbonate salt at an elevated temperature of at least 140° F. said solution having a pH of between about 8 and 11;

(b) providing an aqueous acid solution comprising 0.1 to 16% by weight of an acid at an elevated temperature of at least 140° F. said acid solution having a pH of between about 3 and 6;

(c) directing said carbonate salt solution at said elevated temperature directly onto said textile fibers at ambient pressure as a spray or sheet of solution; and, (d) immediately directing said acid solution onto the same textile fibers at said elevated temperature at ambient pressure as a spray or sheet of solution whereby said carbonate salt solution and said acid solution are combined on said fibers to form a carbonating solution such that the carbonating solution and the carbon dioxide produced by said carbonating solution comes into contact with and clean said textile fibers.

11. The method according to claim 10 wherein said carbonating solution is formed on and comes into contact with said textile fibers at an essentially neutral pH.

12. The method according to claim 11 wherein the carbonate salt solution contains a member selected from the group consisting of sodium carbonate, sodium percarbonate, sodium bicarbonate, lithium carbonate, lithium percarbonate, lithium bicarbonate, potassium, carbonate, potassium percarbonate, potassium bicarbonate, ammonium carbonate, ammonium bicarbonate and mixtures thereof.

13. The method according to claim 12 wherein the acid solution contains an acid selected from the group consisting of citric acid, succinic acid, tartaric acid, adipic acid, glutaric acid, malic acid, oxalic acid and mixtures thereof.

14. The method according to claim 13 wherein urea or an urea analog is contained in at least one of said acid or carbonate salt solutions.

15. The method according to claim 14 wherein urea is contained in at least one of said acid or carbonate salt solutions.

16. The method according to claim 15 wherein urea is contained in said acid solution.

17. The method according to claim 16 wherein the urea is present in an amount sufficient to be present in said carbonating solution in an amount of between about 0.1 to 5% by weight.

18. The method according to claim 17 wherein the carbonate salt is sodium carbonate.

19. The method according to claim 18 wherein the acid is citric acid.

20. The method according to claim 19 wherein the acid solution is buffered at a pH of between 3 and 6 by a carbonate salt and the carbonate salt solution is buffered at a pH of between 8 and 11 by an acid.

21. The method according to claim 10 wherein, following formation of said carbonating solution, said fibers are contacted with absorbent means to remove remaining carbonating solution and soil and residue released from said fibers by said solution.

22. The method according to claim 21 wherein said absorbent means is in the form of a rotating absorbent pad.

* * * * *